United States Patent [19]

Hammer et al.

[11] 4,149,327

[45] Apr. 17, 1979

[54] STEAM IRON

[75] Inventors: Urs Hammer, Oberbuchsiten; Ernst Gisiger, Niederbuchsiten, both of Switzerland

[73] Assignee: Jura Elektroapparate-Fabriken L. Henzirohs A.G., Soleure, Switzerland

[21] Appl. No.: 814,470

[22] Filed: Jul. 11, 1977

[30] Foreign Application Priority Data

Jul. 21, 1976 [CH] Switzerland ..... 9325/76

[51] Int. Cl.[2] ..... D06F 75/06; B67D 5/06

[52] U.S. Cl. ..... 38/77.5; 222/191

[58] Field of Search ..... 38/77.5, 77.6, 77.7, 38/77.8, 77.81, 77.82, 77.83; 222/321, 385, 191, 319, 335, 385, 400.5, 400.8, 401

[56] References Cited

U.S. PATENT DOCUMENTS

| | | | |
|---|---|---|---|
| 1,730,684 | 10/1926 | Phillips | 222/321 |
| 2,546,258 | 3/1951 | Farrell | 222/319 |
| 2,991,572 | 7/1961 | Swenson | 38/77.83 |
| 3,218,742 | 11/1965 | Carabet et al. | 38/77.5 |
| 3,287,837 | 11/1966 | Franklin | 38/77.5 |
| 3,379,381 | 4/1968 | Decaux | 222/385 X |

*Primary Examiner*—Patrick D. Lawson

*Attorney, Agent, or Firm*—Zarley, McKee, Thomte, Vorhees & Sease

[57] ABSTRACT

A steam iron having a forward-pointing spray nozzle for dampening laundry being ironed provides for a substantially greater spray area to be covered by including a water-supply channel passing from a pump through the pump piston-rod to the spray nozzle which is secured to the piston rod. Manipulation of an operating button causes the spray nozzle to move up and down with the piston rod while spraying is taking place, as well as causing a valve port to be opened, closed, and scraped out simultaneously.

1 Claim, 1 Drawing Figure

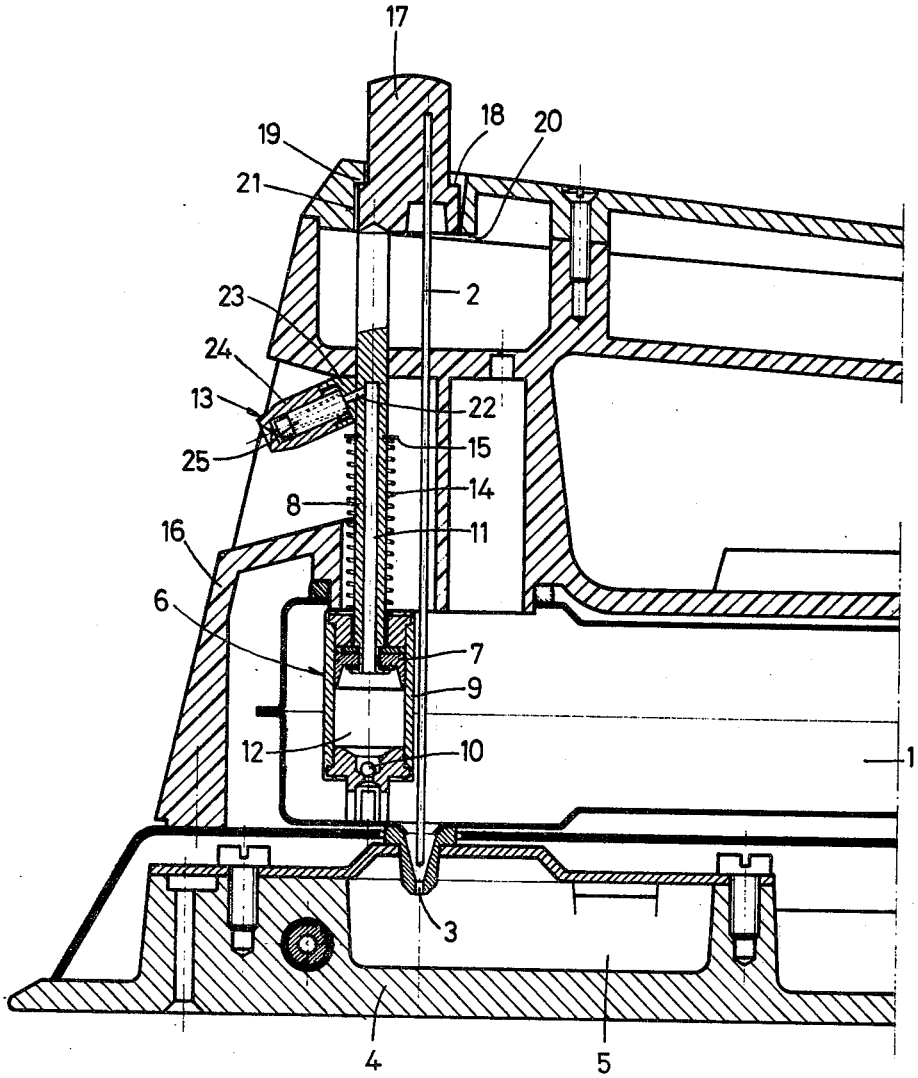
17
18
20
19
21
2
23
24
22
13
15
25
14
8
11
16
6
7
9
12
10
1
3
4
5

STEAM IRON

This invention relates to steam irons of the type wherein a forward-pointing spray nozzle for dampening the laundry being ironed is fed by a pump which is disposed in a water reservoir and has a piston rod.

Steam irons of this type are already known. They comprise a spray nozzle which is rigidly fixed to the frame of the iron and which is fed from the pump through a special feed line. One disadvantage of this arrangement is that the spray area is limited because of the fixed position of the nozzle. Moreover, the provision of a special water-feed line from the pump to the spray nozzle necessitates additional expenditures and complicates assembly.

It is an object of this invention, to provide an improved steam iron of the afore-mentioned type which allows a substantially greater spray area to be covered and which needs fewer components, so that it is also easier to assemble.

To this end, in the steam iron according to the present invention, the improvement comprises a water-supply channel communicating with both the pump and the spray nozzle and passing through the piston rod, the spray nozzle being secured to the piston rod.

A preferred embodiment of the invention will now be described in detail, by way of example, with reference to the accompanying drawing, the sole FIGURE of which is a section through the front part of a steam iron according to the invention.

The illustrated steam iron is similar in its construction to the known steam irons of this type in that a water reservoir 1 communicates with a steam chamber 5, disposed in a heatable sole plate 4, by means of a valve port 3 which can be closed by a valve stem 2. Disposed within the reservoir 1 is a pump 6 having a piston 7, a piston rod 8, a cylinder 9, and a check valve 10 which opens the inlet of the cylinder 9 for water flowing in from the reservoir 1 but prevents water from leaving the cylinder 9. Through the piston rod 8 there passes a water-supply channel 11 which communicates with a pump chamber 12 of the pump 6 at one end and with a nozzle 13 secured to the piston rod 8 at the other end. The nozzle 13 comprises a coupling piece 23, which is secured to the piston rod 8 and through which a nozzle duct 22 passes, and a hollow nozzle body 24 screwed to the coupling piece 23. Disposed within a hollow space inside the nozzle body 24 is an axially movable valve piece 25 which frees the mouth of the nozzle 13 in the case of overpressure in the duct 22 and which closes that mouth in the case of underpressure.

The piston rod 8 passes through a compression spring 14, one end of which rests against a circlip 15 fixed to the rod 8 itself, and the other end of which rests against the top of the pump 6 fixed within a housing 16 of the steam iron. The spring 14 thus has the tendency to keep the piston rod 8 in its uppermost position as shown in the drawing. The upward movement of the rod 8 is limited by an operating button 17, an annular shoulder 18 of which engages under an upper stop surface 19 of the housing 16.

The lower, inner edge 20 of an aperture 21 provided in the housing 16 for the passage of the button 17 additionally forms a lower stop surface under which the button 17, in which the upper end of the valve stem 2 is fixed, may also be engaged and held in its depressed position.

The up-and-down movements of the button 17 are transmitted via the piston rod 8 to the piston 7 of the pump 6, so that during the upward movement water is drawn out of the reservoir 1 through the check valve 10. This suction operation produces an underpressure in the channel 11 and in the duct 22, so that the valve piece 25 blocks the nozzle 13. When the button 17 is depressed, the water trapped in the cylinder 9 by the check valve 10 is pushed upwards through the channel 11 into the nozzle 13 whence it is sprayed out since the resultant overpressure causes the valve piece 25 to free the mouth of the nozzle 13.

Inasmuch as the nozzle 13 is fixed to the piston rod 8, the former moves up and down with the latter in rhythm with the movements imparted to the button 17, so that the spray area is substantially increased.

These up-and-down movements are furthermore transmitted to the valve stem 2, which not only opens and closes the valve port 3 but at the same time scrapes mineral deposits from the inside wall of the valve port 3. Hence the fixing of the valve stem 2 to the button 17 provides the added advantage of an increased scraping effect.

If it is desired to close the valve port 3 and simultaneously discontinue operation of the nozzle 13 for the purpose of dry ironing, it suffices to depress the button 17 until its annular shoulder 18 engages beneath the edge 20, which is achieved by means of a slight pivoting of the button 17.

In the manner described above, it becomes possible to increase considerably the spraying area of a steam iron having a spray nozzle and, at the same time, to dispense with any additional feed line for supplying water from the pump 6 to the spray nozzle 13. Moreover, it is a simple matter to close the valve port 3 and shut off the spray from the nozzle 13 when it is desired to iron dry, and simultaneously to achieve increased scraping of the inside of the valve port 3 as well.

What is claimed is:

1. In a steam iron of the type having a water reservoir in which a pump having a piston rod is disposed, bias means on said piston rod for urging said rod upwardly with respect to said pump, an operating button secured to said piston rod for vertical movement therewith, said pump being actuated in response to depression of said button and rod against the urging of said bias means, and a forward-pointing spray nozzle fed by said pump, said steam iron further comprising a steam chamber, a valve port disposed between said water reservoir and said steam chamber and a valve stem for opening and closing said valve port, the improvement comprising: a water-supply channel communicating with both said pump and said spray nozzle and passing through said piston rod, said spray nozzle being secured to said piston rod for vertical movement therewith whereby upon depression of said operating button, water is pumped through said channel and downwardly moving spray nozzle, and said valve stem also being secured to said operating button for vertical movement therewith whereby said valve port is closed upon depression of said operating button and opened in response to upward movement of said operating button by said bias means.

* * * * *